United States Patent [19]

Patterson

[11] 4,284,173

[45] Aug. 18, 1981

[54] MOTOR VEHICLE LUBRICATING FACILITY

[75] Inventor: Paul C. Patterson, St. Albans, W. Va.

[73] Assignee: Pennzoil Company, Pittsburgh, Pa.

[21] Appl. No.: 93,750

[22] Filed: Nov. 13, 1979

[51] Int. Cl.[3] ..... F16C 3/14

[52] U.S. Cl. ..... 184/1.5; 137/234.6; 137/342; 52/174; 52/236.3; 182/119; 182/179

[58] Field of Search ..... 137/234.6, 242; 184/1.5; 141/98; 182/179, 119; 52/33, 236.3, 173, 174, 175

[56] References Cited

U.S. PATENT DOCUMENTS

| | | | |
|---|---|---|---|
| 1,357,022 | 10/1920 | Bahls | 184/1.5 |
| 1,575,371 | 3/1926 | Lowden | 184/1.5 |
| 1,896,610 | 2/1933 | Counce | 184/1.5 |
| 2,898,641 | 8/1959 | Battista | 52/174 X |
| 3,675,736 | 7/1972 | Roggle | 182/119 X |
| 4,188,985 | 2/1980 | Osterman | 137/234.5 X |

*Primary Examiner*—Harold W. Weakley

*Attorney, Agent, or Firm*—Buell, Blenko, Ziesenheim & Beck

[57] ABSTRACT

A motor vehicle lubricating facility for enabling a workman to perform lubricating functions on an automobile rapidly and efficiently with a minimum of waste time and effort. The facility comprises a building structure with a basement floor and a ground floor supported on columns above the basement floor. In the ground floor are a plurality of rectangular longitudinal openings in parallel relation, each adapted to be straddled by an automobile driven over the ground floor through door openings at the front and back of the building structure. Adjustably supported at a selected one of several heights on the columns between the ground and basement floor and substantially coinciding in area with each of the openings in the ground floor, is a "catwalk" or grilled metal platform, on which a workman may stand to perform lubricating functions with respect to parts of the automobile accessible only from beneath the automobile. The I-beams supporting the ground floor at each side of the openings in the ground floor provide tracks on which runs a mobile dolly of the type carrying a power jack as fully disclosed and claimed in my copending application concurrently filed herewith. A mobile tank operating on the same tracks as the dolly, is provided into which oil may be drained directly from the crank case, differential or transmission of an automobile. A metered hose line is provided by which oil or other lubricants supplied therethrough to the work area is automatically measured. A work shelf is suspended from the columns at one side of the catwalk for holding tools and the like used by the workman.

7 Claims, 5 Drawing Figures

MOTOR VEHICLE LUBRICATING FACILITY

This invention relates to lubricating facilities for motor vehicles, hereafter referred to as automobiles, particularly those of the type in which the automobile is driven over a longitudinal work pit in which the person performing the lubricating functions stands to attain access to lubricating fittings or parts on the vehicle from below the vehicle.

Another type of well known lubricating facility for automobiles provides a spider member adjustable beneath the frame or chassis of an automobile, or tracks on which the automobile is driven. The spider member or tracks have a central hydraulic cylinder for elevating the automobile while supported thereon to an appropriate height above the ground for access by a workman on the ground to lubricating fittings on the underside of the vehicle.

Both types of lubricating facilities as currently known and used are subject to disadvantages or inconveniences so far as the workman performing the lubricating functions is concerned. For example, unless the underside of an automobile is an appropriate height above the ground, it is difficult for a workman standing on the ground to conveniently reach the fittings on the automobile. Also, in some cases, it is necessary to raise the body of the vehicle with respect to the chassis or frame in order to reach some lubricating fittings. This is not possible without special jacks, which require some maneuvering and are difficult to orient. Also, considerable time and lost motion is involved for a workman to reach tools while under the automobile.

There are other disadvantages in existing lubricating facilities including lack of proper illumination, lack of warmth especially in cold weather, and difficulty in removing and transporting waste oil drained from a vehicle.

It is the purpose of my invention to provide a lubricating facility for automobiles which removes many of the disadvantages of existing facilities and which enables a workman to work more comfortably and more efficiently while performing the lubrication operations.

I, therefore, provide a permanent building structure having a ground floor superposed on columns over a basement floor, with rectangular holes in the ground floor adapted to be straddled by an automobile driven thereover. A metal grid platform or catwalk is adjustably supported on the columns in registry with the holes in the ground floor at a selected height above the basement floor on which a workman may stand to perform lubricating functions on the automobile. The I-beams supporting the ground floor along each side of the longitudinal hole provide a track on which runs a wheeled truck or dolly carrying a power jack maneuverable by a workman on the catwalk to engage the body of the automobile and raise or lower it with respect to the chassis as desired under manual control. The details of the wheeled truck and power jack are described and claimed in my copending application filed concurrently herewith.

I further provide a mobile tank, having wheels which run on the same I-beam tracks as the truck carrying the power jack, into which tank oil may be drained from the automobile. A storage tank for used oil and lubricant is provided below ground level outside the foundation wall of the building. The waste oil in the mobile tank is transferred by gravity to the outside storage tank via a hose having a separable connection at the inside of the foundation wall to a pipe leading to the outside storage tank.

I further provide a shelf supported at an appropriate height on the columns paralleling the catwalk for holding tools and other devices for ready and quick accessibility to the workman on the catwalk performing the lubricating functions.

The above structures are fully described hereinafter, along with other features, in relation to the accompanying drawings, wherein.

Figure 1:
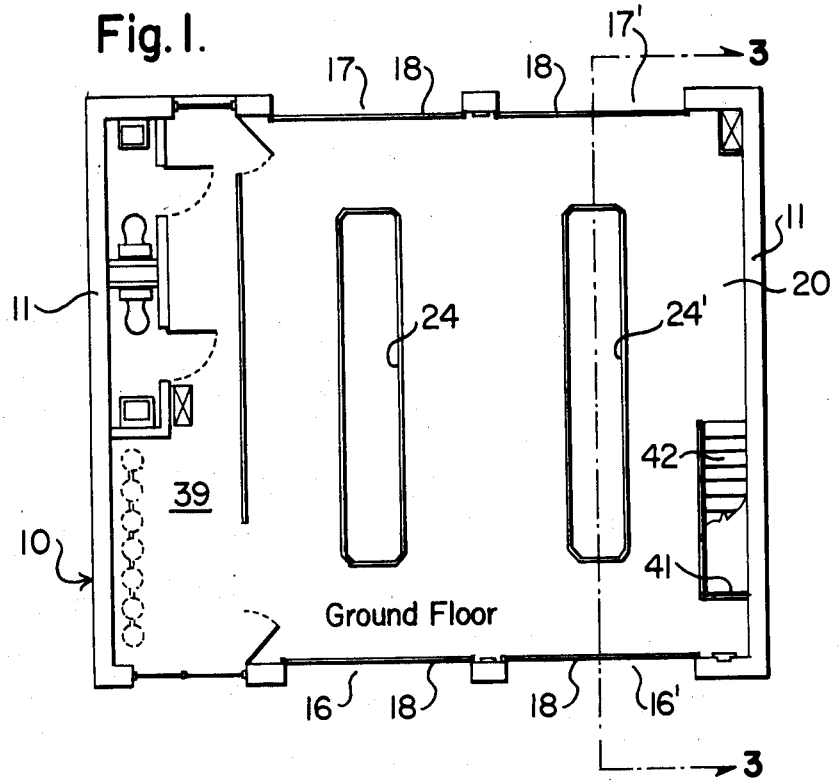
FIG. 1 is a ground floor plan view of the building structure constituting a preferred embodiment of my invention.
Figure 2:
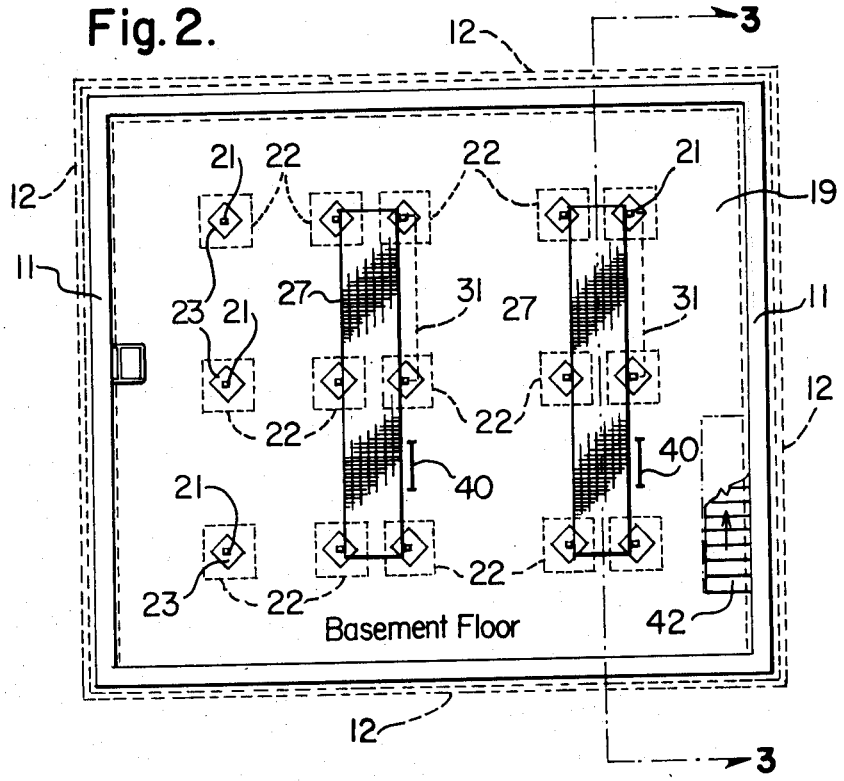
FIG. 2 is a basement and foundation plan view of the building structure in FIG. 1.
Figure 3:
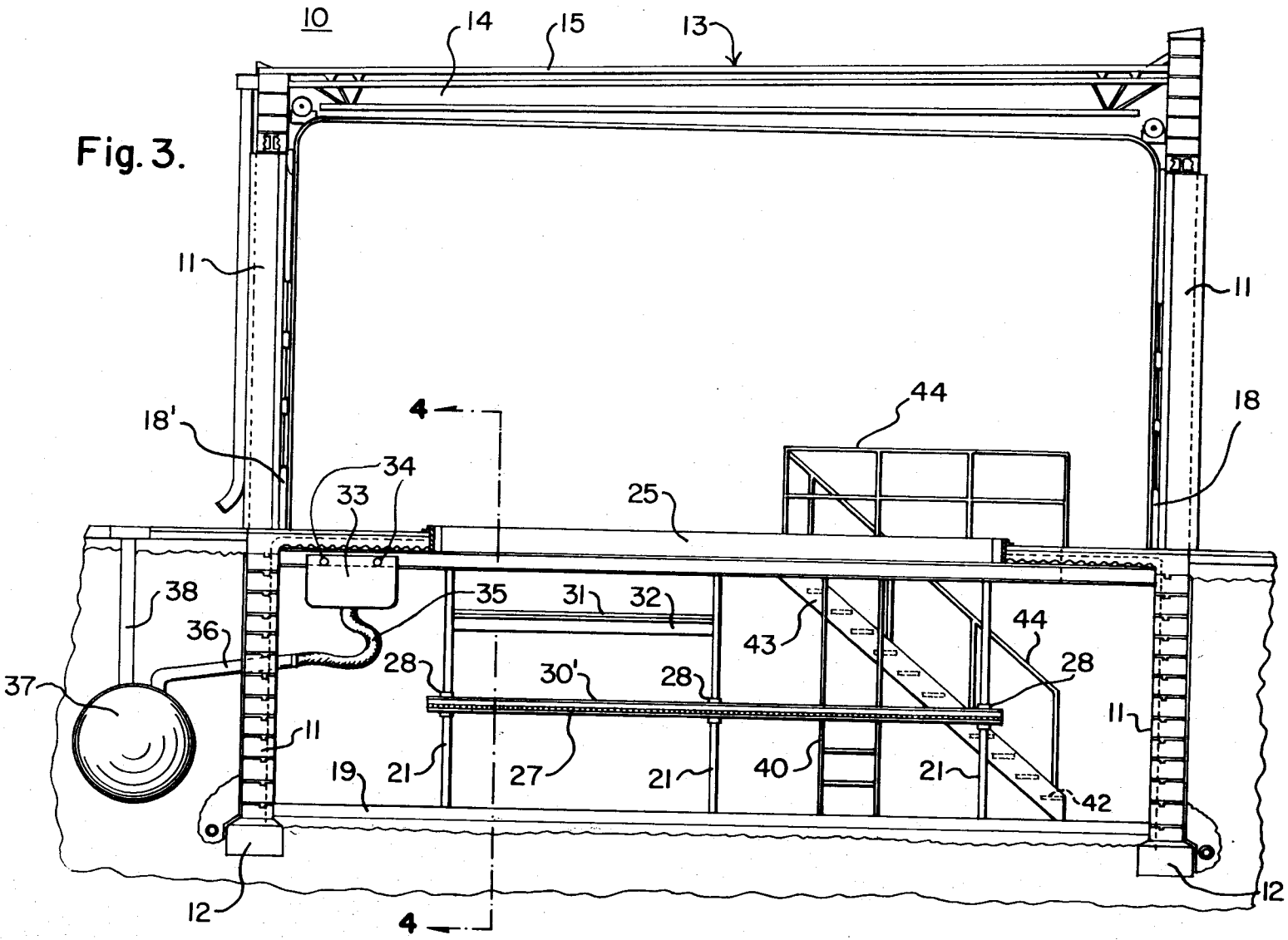
FIG. 3 is an elevational sectional view of the building structure, taken along the line 3—3 of both FIG. 1 and FIG. 2.

Referring to the drawings, particularly FIGS. 1, 2 and 3, it will be seen that the facility comprises a building structure 10 of brick and exterior facing tile walls 11 erected on a concrete footer 12. The roof 13 is conventional in nature, having steel trusses 14 supported at opposite ends on the top of the front and back walls, with corrugated sheet metal roofing 15 supported on the trusses. Aligned doorways 16, 16' and 17, 17' are provided respectively in the front and rear walls at ground level with sectionalized overhead doors 18 for closing the doorways.

There are reinforced concrete floors in the building, one of which is called the basement floor 19 (FIG. 2) and the other which is called the ground floor 20 (FIG. 1). As shown in FIG. 2, the ground floor 20 is supported at spaced points by square tubular steel columns 21 embedded into and resting on square concrete footers 22 below the surface of the concrete basement floor 19. After the concrete basement floor is poured and has hardened, an additional square concrete anchoring slab 23 is poured, in suitable molds surrounding the columns, flush with the surface of the basement floor.

As shown in FIG. 1, the ground floor 20 is formed with a plurality, illustratively shown as two in number, of longitudinal slots or openings 24 and 24' which provide a working space for a workman to perform lubricating functions on the underside of an automobile. As apparent in FIG. 1, automobiles are driven through the doorways 16, 16' in the front wall over and in straddling relation to the longitudinal openings 24 and 24', exiting out through the doorways 17 and 17' in the rear wall of the building. The sides of the openings 24 and 24' in the concrete ground floor 20 are lined with strips of steel plate 25 attached as by welding, to the top flange of I-beams 26 and 26' that rest on the tops of the columns 21 and that serve as joists for supporting the ground floor 20. The strips of steel plate 25 project above the level of the ground floor and serve to guide the tires on the automobile wheels.

Figure 5:
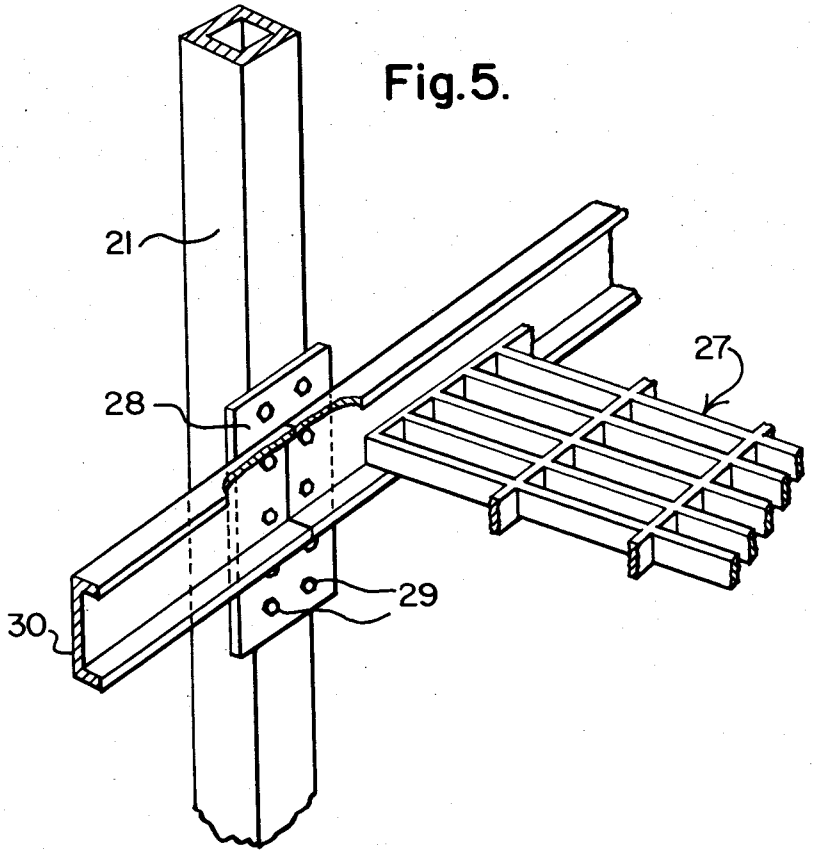
FIG. 5 is a fragmental view, in perspective, showing details of the adjustable support for the catwalk.

A catwalk 27, or metal grid platform coinciding substantially in area with the area of the openings 24 and 24' is adjustably supported on two parallel rows of columns 21 at an appropriate selected height above the surface of the basement floor, suited to the height of the workman performing lubricating functions on the automobile straddling the openings 24, 24' overhead. As seen in FIGS. 3 and 5, a rectangular steel plate 28 is secured in a vertical position at corresponding levels to each of the tubular columns of the two parallel rows by a series of vertically spaced pairs of bolts 29. If desired, the plate 28 may also be attached to the column by welding. To provide a track to support the metal grid platform, a pair of opposed steel channels 30 and 30' are secured in a horizontal position at the same level, by certain of the bolts 29, to the steel plates 28 on longitudinally spaced columns 21. The catwalk 27, which may be made in several sections, is inserted into the grooves in the channels and rests on the lower flange of the channels 30 and 30'. The height of the catwalk 27 above the surface of the basement floor 19 may be varied to suit the individual workman simply by selecting higher or lower bolts 29 by which to fasten the channels 30, 30' to the steel plates 28.

Figure 4:
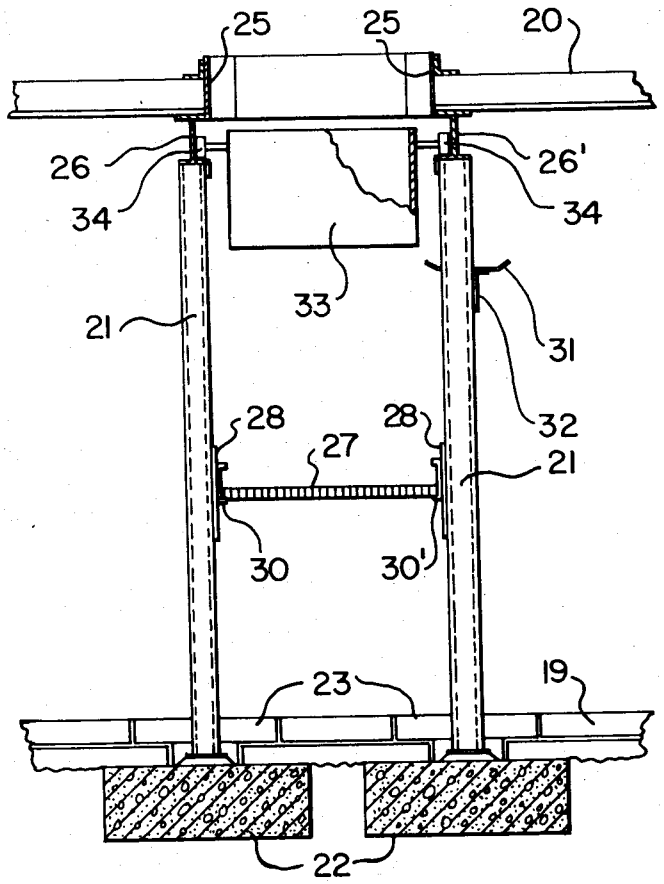
FIG. 4 is a fragmental elevational sectional view, taken along the line 4—4 of FIG. 3.

A workshelf 31 is provided in parallel relation to and above the catwalk 27, as shown in FIGS. 3 and 4. The shelf 31 consists simply of a suitable length of steel plate about a foot wide, having the edges bent up at an angle and welded to the flange of a steel T-bar 32 attached at its opposite ends to the side faces of two aligned columns 21.

A mobile dolly or truck not shown, but fully described in another of my applications concurrently filed herewith, has flanged wheels which travel on the lower flange of the two parallel floor supporting I-beams 26 and 26' at opposite sides of each of the longitudinal openings 24 and 24'. This dolly has a hydraulic jack thereon which may be shifted slidably transversely of the openings 24 and 24' by the workman to engage a part of the automobile body or chassis to raise it as desired to obtain access to lubrication fittings. The hydraulic jack, may also be swung down into the space below the ground floor 20 so as not to interfere with free entry and departure of an automobile into and from its position above and straddling the openings 24 and 24'. It will be understood that a workman standing on the catwalk 27 may thus conveniently control the positioning of the hydraulic jack by means of control devices on the dolly conveniently reached by the workman.

Another advantageous element of this facility provided is a mobile tank 33 having a pair of wheels 34 carried at each side of the tank on suitable axles or rods, by which the tank may be manually moved to a desired position beneath the automobile. Tank 33 may be used to hold oil drained from the crankcase, differential or transmission of an automobile. Heretofore, the removal of oil drained from an automobile has been a problem, as it must be transported manually away from the work area. In this facility, the mobile tank 33 may simply be moved along the I-beams 26, 26' to the rear end of the building structure 10, where a flexible drain tube 35 on the tank 33 may be connected, as by a severable coupling, to a drain pipe 36 extending through the foundation wall of the building structure to a large capacity storage tank 37 which is buried well below the grade line in the soil surrounding the building. The storage tank 37 has an access tube 38 extending vertically upward from the tank to the grade level. When it is desired to remove the waste oil from tank 37, a suitable cap is first removed from the upper end of tube 38 and then a suction hose (not shown) connected to a suction pump may be lowered through tube 38 into the tank.

Other conveniences for the workman are further provided, such as toilet and washing facilities shown at 39 on the ground floor plan of FIG. 1. Space for storage of supplies of various kinds is also available on the ground floor.

As shown in FIGS. 2 and 3 a steel ladder 40 is secured in vertical position at one side of each of the openings 24 and 24' to enable a workman to climb to the catwalk 27 from the basement floor 19, or to descend from the catwalk. Also, a stair well 41 in ground floor 20 and stairs 42 consisting of steel treads attached as by welding to steel side supports 43 are provided between the basement and ground floors, with suitable hand rails 44 of piping.

While not shown, it should be understood that a metered hose line is provided having a nozzle accessible to a workman on the platform 27, by which oil or other lubricants may be supplied in measured quantities as needed in lubricating operations without requiring the workman to leave the platform. It will be further understood that suitable ventilating and heating facilities are provided on both the basement and ground floors. Also, appropriate electrical wiring, lighting and outlets are provided, to provide proper lighting for the workman especially while standing on the catwalks 27.

It will be understood that modifications in the building structure and in the arrangement of facilities therein may be made within the scope of the appended claims.

I claim:

1. A motor vehicle lubricating facility comprising a building structure having a plurality of superposed floors, one of said floors having a substantially rectangular opening therein over which an automobile may be driven in straddling relation thereto, a platform generally conforming in area to that of said rectangular opening, a plurality of supporting columns extending between said floors, a pair of horizontal channels disposed in opposed parallel spaced relation supporting opposite edges of said platform and means for attaching said channels to said columns at different levels whereby to support said platform adjustably at different levels beneath said opening on which a workman may stand to perform lubricating functions on an automobile, standing over said opening, from beneath the automobile.

2. A motor vehicle lubricating facility according to claim 1, wherein said platform comprises a plurality of separate contiguous rectangular sections of metal grid supported on the lower flanges of said pair of opposed parallel channel members.

3. A motor vehicle lubricating facility comprising a building structure having a plurality of superposed floors, one of said floors being supported in part by a plurality of vertical columns, said one floor having a substantially rectangular opening surrounded peripherally by said columns, a platform conforming generally in area to that of said rectangular opening, a pair of horizontal channels disposed in opposed spaced relation in which the opposite edges of said platform are supported, vertically disposed plate members attached to said vertical columns each having a plurality of vertically spaced holes, and detachable means engageable with said holes for attaching said channels to said plate members thereby to support said platform adjustably on said columns at varying levels beneath said opening on which a workman may stand to perform lubricating functions on an automobile standing over said opening from beneath the automobile.

4. A motor vehicle lubricating facility according to claim 3, wherein a workshelf is located between said floors in substantial parallel relation to and alongside said platform, for convenient accessibility by a workman on said platform, and means attached to said columns that supports said shelf in position.

5. A motor vehicle lubricating facility according to claim 3, wherein a workshelf is supported alongside a portion of said platform, said workshelf comprising a T-bar extending between a pair of said columns and attached thereto, and a metal plate attached to the horizontal flanges of said T-bar.

6. A motor vehicle lubricating facility comprising a generally rectangular building structure having a ground floor, a basement floor below said ground floor, and vertical columns therebetween, aligned doorways in the front and rear walls at ground level for travel of automobiles through the building from front to back on the ground floor, a plurality of parallel extending generally rectangular openings in the ground floor each so aligned with doorways in the front and rear walls of the building as to enable an automobile entering the building through a doorway in a front wall and exiting through a doorway in the rear wall to straddle the corresponding said rectangular opening, wherein the improvement comprises a platform generally conforming in area to that of said openings located between the ground floor and the basement floor on which a workman may stand to perform lubricating functions from beneath an automobile straddling the rectangular opening in said ground floor, a pair of horizontal channels in parallel spaced relation in which the opposite edges of said platforms are retained, and means for detachably securing said channels to said vertical columns in different positions to adjustably support said platforms at different levels.

7. A motor vehicle lubricating facility comprising a generally rectangular building structure having a ground floor and a basement floor, said ground floor having rectangular openings therein and access to and egress from the ground floor for automobiles to pass in straddling relation to said openings, said ground floor having supporting I-beams at each side of the rectangular openings, said I-beams having a vertical web and upper and lower flanges, a platform below said rectangular openings on which a workman may stand, to perform lubricating functions from beneath an automobile, means for adjusting the level of said platform relative to said ground floor and a tank for holding waste oil and lubricant drained from the automobile, said tank having wheels on opposite ends thereof that roll on the lower flanges of the said I-beams, whereby to allow the workman on said platform to move said tank longitudinally relative to said rectangular openings.

* * * * *